US011906259B2

(12) United States Patent
Wiseman et al.

(10) Patent No.: US 11,906,259 B2
(45) **Date of Patent: *Feb. 20, 2024**

(54) UNIVERSAL RECEIVER TEST FIXTURE

(71) Applicant: Bill Wiseman & Co., Inc., College Station, TX (US)

(72) Inventors: William Wiseman, College Station, TX (US); James Darley, Magnolia, TX (US); Levi Munoz, Navasota, TX (US)

(73) Assignee: Bill Wiseman & Co., Inc., College Station, TX (US)

( * ) Notice: Subject to any disclaimer, the term of this patent is extended or adjusted under 35 U.S.C. 154(b) by 596 days.

This patent is subject to a terminal disclaimer.

(21) Appl. No.: 17/147,003

(22) Filed: Jan. 12, 2021

(65) Prior Publication Data

US 2021/0222985 A1 Jul. 22, 2021

Related U.S. Application Data

(60) Provisional application No. 62/962,057, filed on Jan. 16, 2020.

(51) Int. Cl.
*F41A 23/16* (2006.01)
*F41A 31/00* (2006.01)
*F41G 11/00* (2006.01)

(52) U.S. Cl.
CPC ..... *F41A 23/16* (2013.01); *F41A 31/00* (2013.01); *F41G 11/001* (2013.01)

(58) Field of Classification Search
None
See application file for complete search history.

(56) References Cited

U.S. PATENT DOCUMENTS 3,863,499 A * 2/1975 Von Boutteville ..... F41A 31/00 73/35.14
10,704,855 B2 * 7/2020 Amburgey ..... F41A 23/16
2021/0116202 A1 * 4/2021 Wiseman ..... F41A 31/02

FOREIGN PATENT DOCUMENTS

CN 111043900 B * 3/2022 ..... F41A 31/00

* cited by examiner

*Primary Examiner* — Peter J Macchiarolo
*Assistant Examiner* — Jermaine L Jenkins
(74) *Attorney, Agent, or Firm* — Harness, Dickey & Pierce, P.L.C.

(57) ABSTRACT

A test fixture for testing firearms or ammunition according to the present disclosure includes a base, a barrel retention assembly, a door, and a firing pin. The base includes a longitudinal channel. The barrel retention assembly is configured to support a firearm barrel in the longitudinal channel. The door is pivotably mounted to the base and is configured to move from a closed position contacting a rear face of the base to an open position spaced from the rear face of the base. The firing pin is supported in a housing. The housing is slideably supported within the base and is configured to move between a first position and a second position. The first position aligns the firing pin and a longitudinal axis of the barrel retention assembly and the second position provides access to the barrel retention assembly.

15 Claims, 7 Drawing Sheets

UNIVERSAL RECEIVER TEST FIXTURE

CROSS-REFERENCE TO RELATED APPLICATIONS

This application claims the benefit of U.S. Provisional Application No. 62/962,057, filed on Jan. 16, 2020. The entire disclosure of the above application is incorporated herein by reference.

FIELD

The present disclosure relates firearms test fixtures, and, more specifically, a universal receiver test fixture.

BACKGROUND

This section provides background information related to the present disclosure which is not necessarily prior art.

Companies or entities purchasing firearms and/or ammunition often test the product before purchase or benchmark the product against other related products. Test fixtures may assist in testing these products.

An example test fixture was originally designed in the military by David J. McNally and was used to test new ammunition designs as well as experimental rifling in barrels. The example design is activated manually by the pull of a lanyard.

SUMMARY

This section provides a general summary of the disclosure, and is not a comprehensive disclosure of its full scope or all of its features.

In an example embodiment, a test fixture for testing firearms or ammunition according to the present disclosure includes a base, a barrel retention assembly, a door, and a firing pin. The base includes a longitudinal channel. The barrel retention assembly is configured to support a firearm barrel in the longitudinal channel. The door is pivotably mounted to the base and is configured to move from a closed position contacting a rear face of the base to an open position spaced from the rear face of the base. The firing pin is supported in a housing. The housing is slideably supported within the base and is configured to move between a first position and a second position. The first position aligns the firing pin and a longitudinal axis of the barrel retention assembly and the second position provides access to the barrel retention assembly.

In an example embodiment, a test fixture for testing firearms or ammunition according to the present disclosure includes a base and an actuation assembly. The base is configured to support a firearm barrel. The actuation assembly is configured to remotely fire a projectile loaded in the firearm barrel. The actuation assembly further includes a coil, an end plate, and a rod projecting from the end plate into the base. When power is supplied to the coil, the coil becomes a magnet and the end plate moves from a position separated from the coil to a position contacting the coil.

In an example embodiment, the base includes a door pivotably attached on a side surface of the base. The door is configured to pivot from a closed position to an open position, and the actuation assembly is fixed to the door.

In an example embodiment, a method of testing firearms or ammunition according to the present disclosure includes opening a door pivotably attached to a base of a test fixture; loading a projectile into a firearm barrel housed in the test fixture; supplying power to an actuation assembly on the door of the test fixture to activate a magnet; and pushing a firing pin in the test fixture into the projectile.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
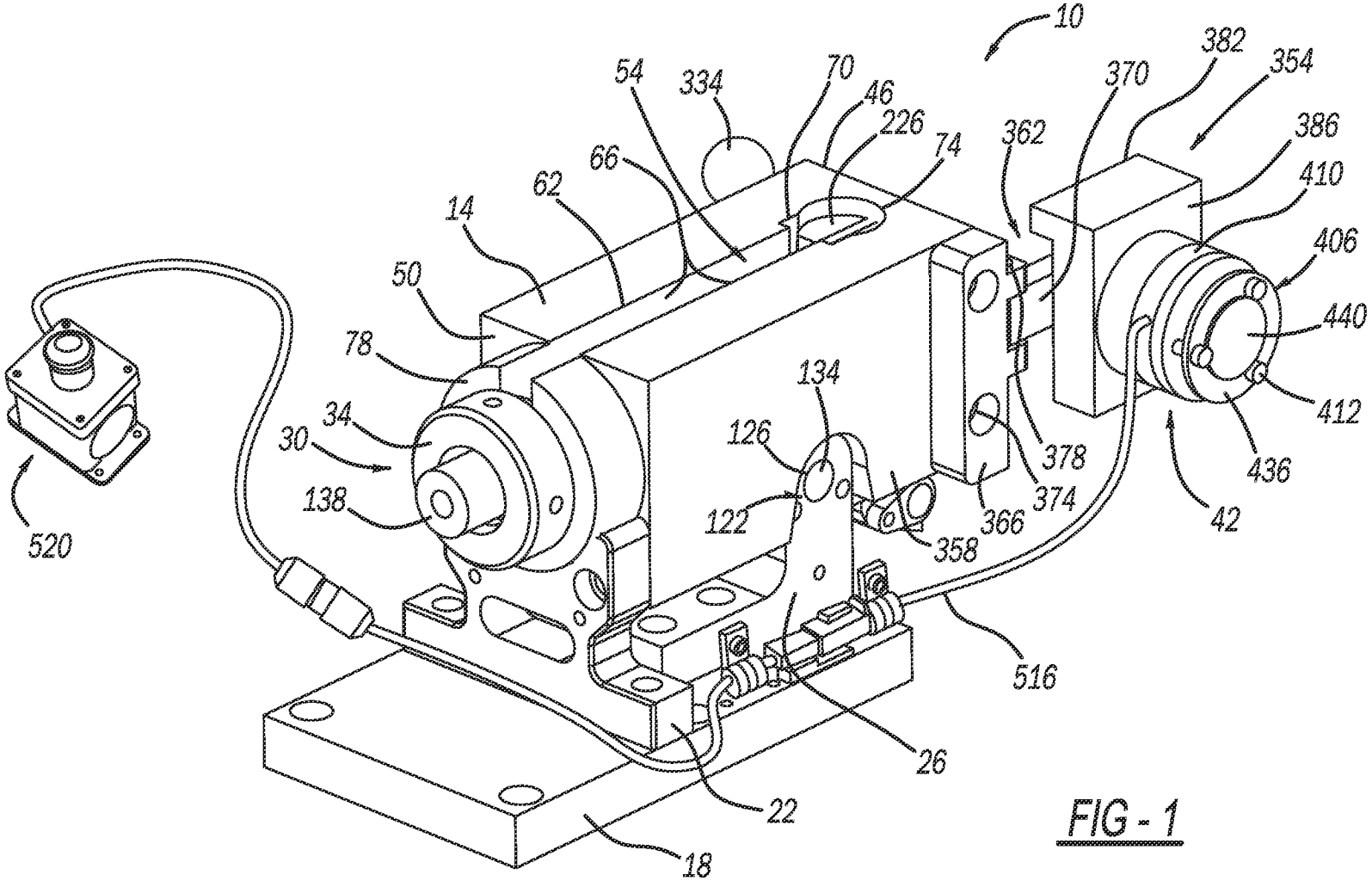
FIG. 1 is a front perspective view of an example embodiment of a test fixture according to the present disclosure.
Figure 2:
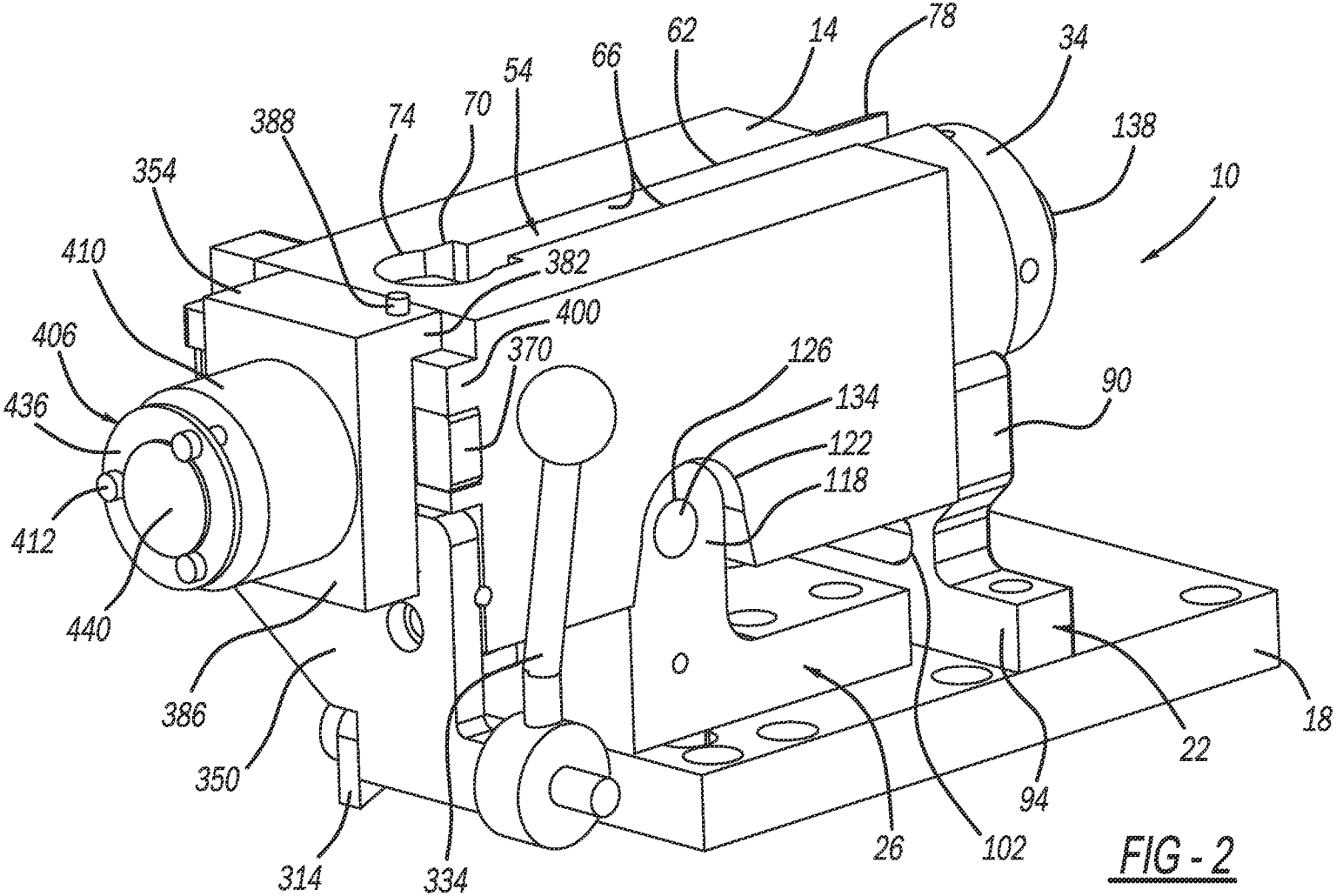
FIG. 2 is a rear perspective view of the example embodiment of the test fixture in FIG. 1.
Figure 3:
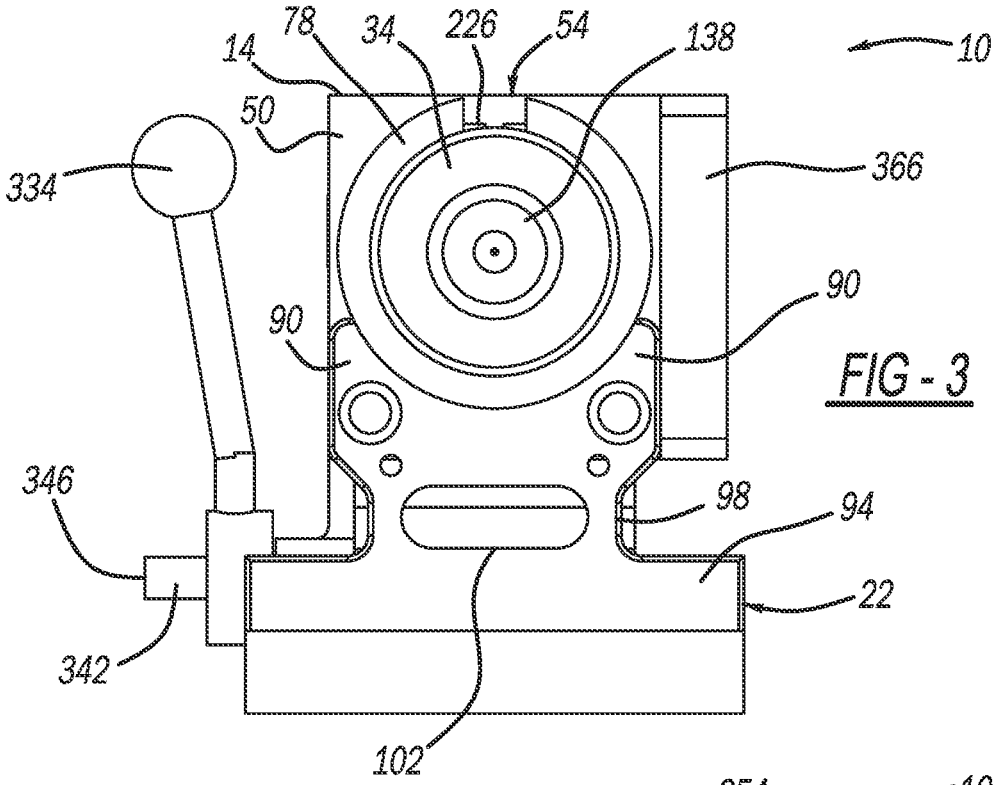
FIG. 3 is a front view of the example embodiment of the test fixture in FIG. 1.
Figure 4:
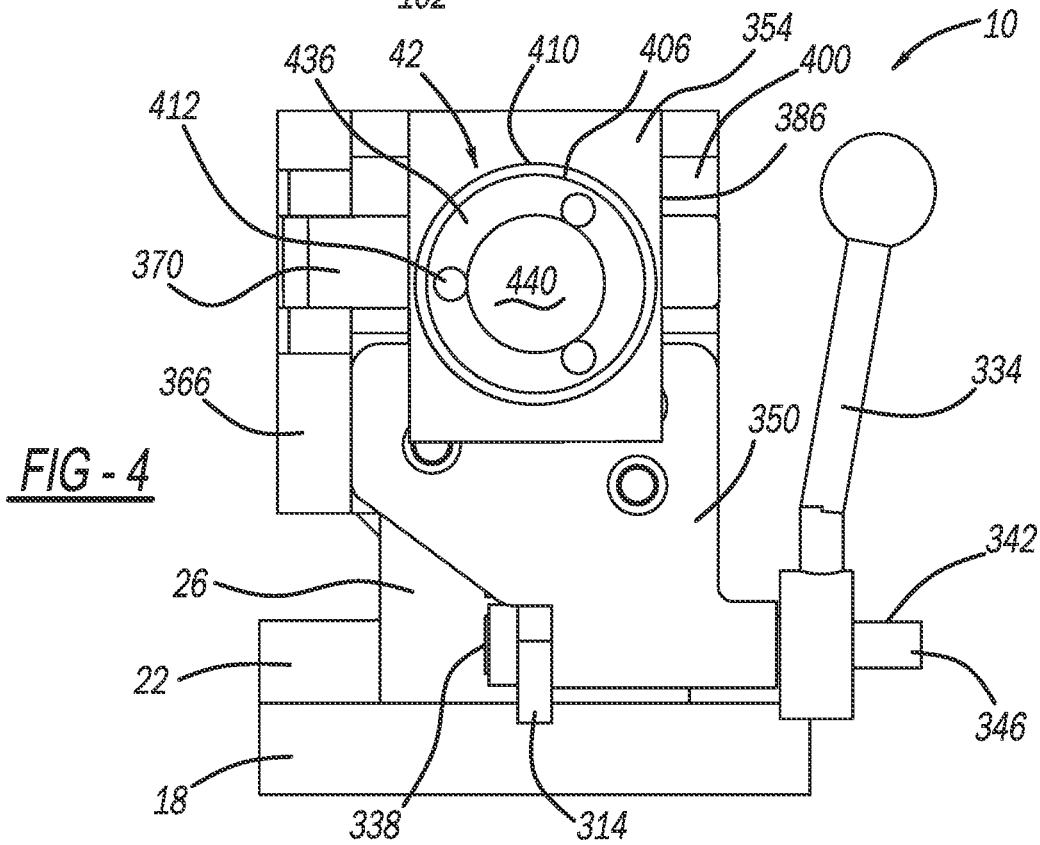
FIG. 4 is a rear view of the example embodiment of the test fixture in FIG. 1.
Figure 5:
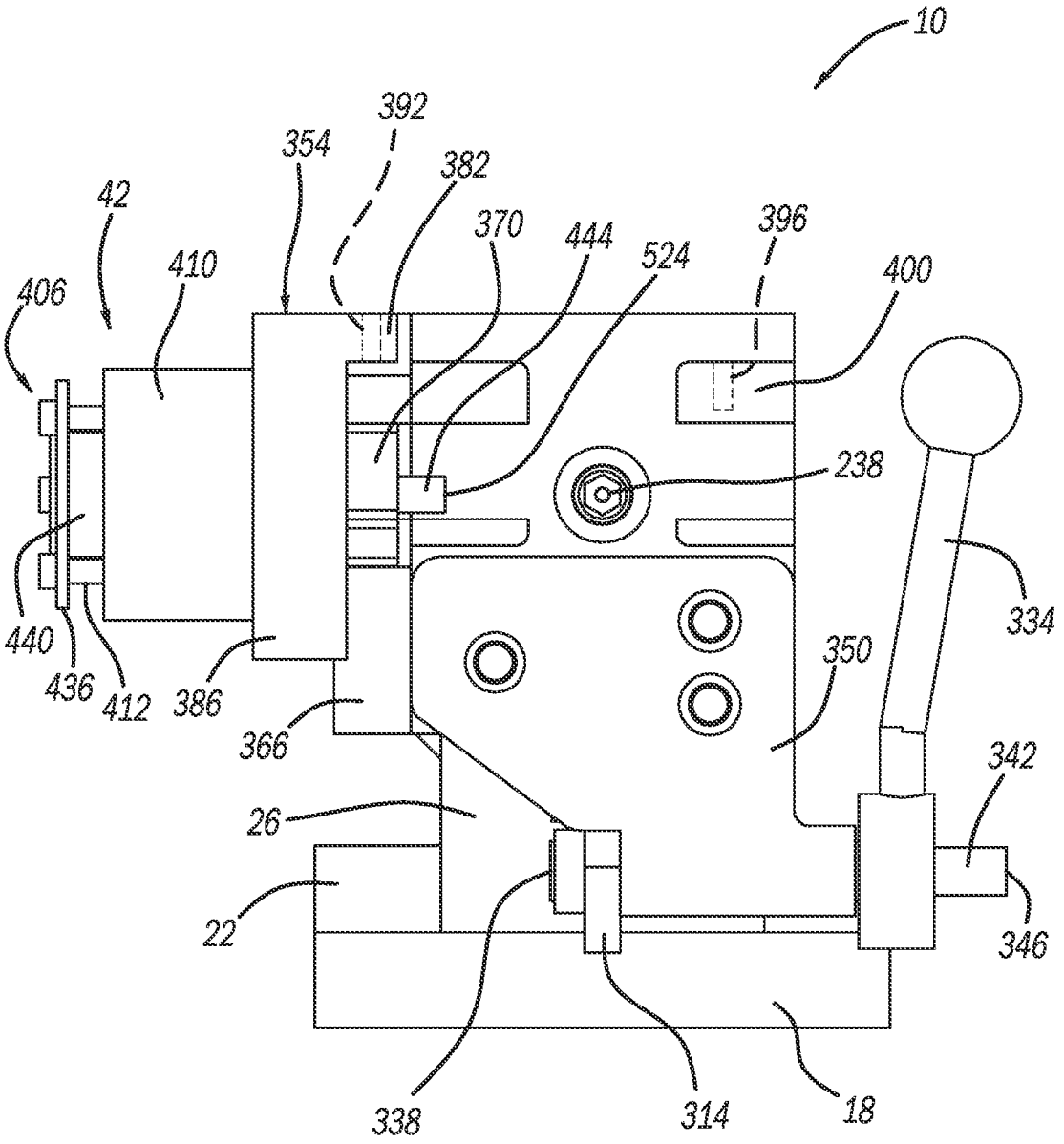
FIG. 5 is another rear view of the example embodiment of the test fixture in FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosure relates to a test fixture that was designed and developed for use by manufacturers or purchasers (such as private entities or the government) when experimenting or benchmarking various suppliers of ammunition and/or various barrel designs. The design of the test fixture removes human variances and allows the tester or user to determine a true accuracy of the barrel or ammunition being tested.

The test fixture of the present disclosure is a universal receiver test fixture. A unique advantage of the test fixture of the present disclosure is that the fixture is able to test a variety of barrels by swapping out interchangeable inserts manufactured to hold an exterior of the barrel. As such, different barrels, held by interchangeable inserts, may be tested using a single test fixture.

Additionally, the test fixture of the present disclosure is operated by pushing a button only requiring a power source from any standard 110 volt AC outlet. The push button actuation feature enables the test fixture to be fired from a safe distance. This helps minimize the risk factor in the testing of experimental ammunition by removing personnel from the close proximity of the unit when fired.

When used with either a pneumatic actuator or an electromagnetic solenoid as described herein, the test fixture provides repeatability in firing, keeping results consistent. With the pneumatic actuator, controlled air is used to activate the firing mechanism, providing a consistent pressure from one activation to the next. With the electromagnetic solenoid, a consistent force is applied to the firing mechanism for each activation.

Finally, the test fixture includes a rear flapper or door that swings open from a body of the test fixture. The flapper or door enables the user to load ammunition into the unit faster and more efficiently. The flapper door houses the firing mechanism and is engaged with an actuation mechanism to provide direct access to the firing pin. The rotational attachment of the flapper or door to the body of the fixture allows the body of the fixture to support the weight of the flapper or door and actuation mechanism without impairing the opening and closing function of the flapper or door.

Now referring to FIG. 1, an example embodiment of a universal receiver test fixture 10 is illustrated. The fixture 10 includes a base, or housing, 14 fixed to a platform 18 by a first, forward mount 22 and a second, rear mount 26. The housing 14 supports a barrel retention assembly 30 that includes a forward retainer 34 and a rearward insert 38 (also FIG. 6) and an actuation assembly 42 that is mounted on a rear face 46 of the base 14. The mounts 22, 26 fix the base 14 such that a front face 50 of the base 14 faces a downrange direction and the rear face 46 of the base 14 faces a direction opposite the front face 50 (for example, a direction of an operator). In an example embodiment, the first and second mounts 22, 26 may be fixed to the platform 18 by a plurality of fasteners or other fixing mechanisms.

Figure 6:
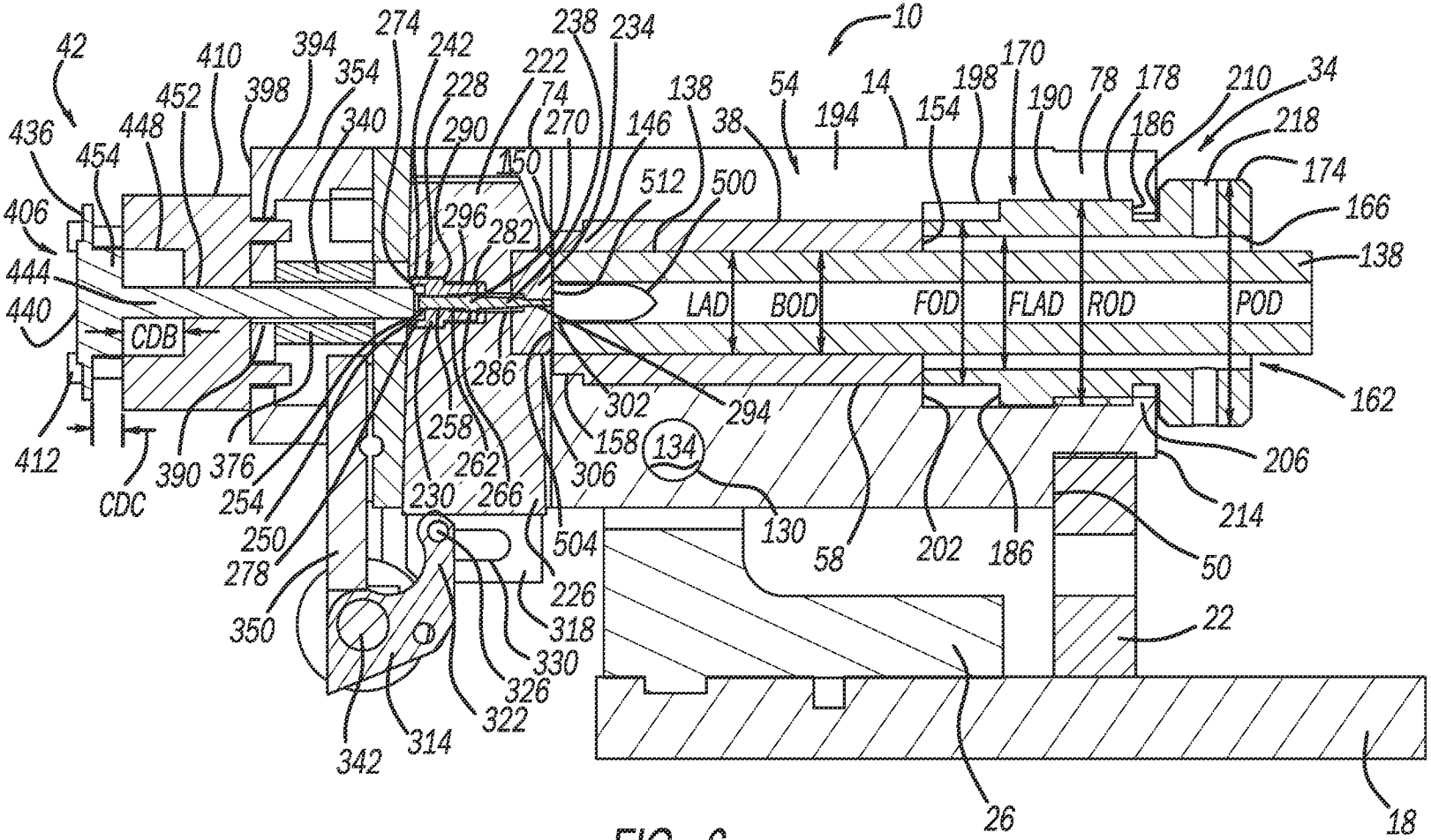
FIG. 6 is a cross-sectional view of the example embodiment of the test fixture in FIG. 1.
Figure 7:
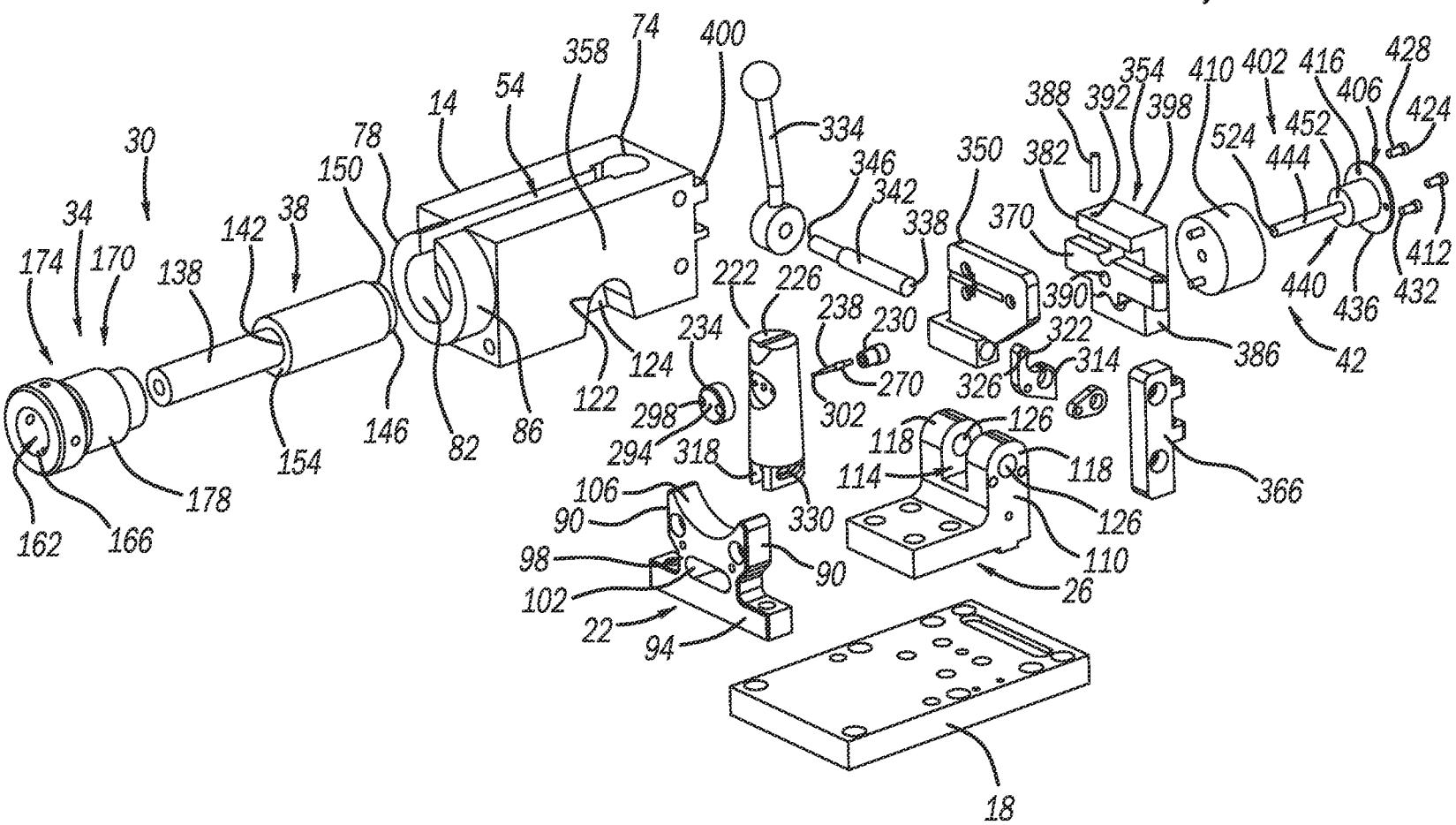
FIG. 7 is an exploded view of the example embodiment of the test fixture in FIG. 1.

Additionally referring to FIGS. 6 and 7, the base 14 may be a rectangular-shaped base having a channel 54 extending longitudinally therethrough. The channel 54 may extend a majority of the longitudinal length of the base 14 and may support at least a portion of the barrel retention assembly 30. The channel 54 may have a u-shaped cross section with a radiused base 58. In an example embodiment, the channel 54 may include a first portion 62 extending from the front face 50 and having parallel walls 66, a stepped portion 70 expanding a width of the channel from the first portion, and a partial circular portion 74 extending from the stepped portion 70.

In an example embodiment, a projection 78 may protrude from the front face 50 of the base 14. The projection 78 may be a support receiving and supporting at least a portion of the barrel retention assembly 30. The projection 78 may be a ring-like, or circular projection having an inner wall 82 and an outer wall 86. The inner wall 82 may have a diameter ID that is less than a diameter OD of the outer wall. The inner wall 82 may align with the radiused base 58 of the channel 54 such that the projection defines an entrance into the channel 54. In an example embodiment, the projection 78 and base 14 may be a single, monolithic part. In another example embodiment, the projection 78 may be fixed, such as welded or otherwise secured, to the base 14.

In an example embodiment, the first mount 22 may support the projection 78 on the platform 18. The first mount 22 may include upwardly curved arms 90 extending from an upside-down t-shaped base 94. A trunk 98 of the base 94 may include an aperture 102 extending therethrough. The aperture 102 may provide for a reduction in weight of the first mount 22.

In an example embodiment, the projection 78 may rest on, and be supported by, a top face 106 of the upwardly curved arms 90. The top face 106 may include a curvature that mates with a curvature of the outer wall 86 of the projection 78.

The second mount 26 may support the base 14 on the platform 18. The second mount 26 may include a u-shaped upright portion 110 having a longitudinal channel 114 defining a pair of uprights 118. The pair of uprights 118 may engage the base 14 at a pair of notches 122. The notches 122 in the base 14 may include a shape that mates with each of the pair of uprights 118. In an example embodiment, the base 14 may include a rail 124 that fits within the channel 114 in the u-shaped portion 110 (between the uprights 118).

In an example embodiment, each of the pair of uprights 118 may include an aperture 126 (FIGS. 1 and 7) therein that aligns with an aperture 130 (FIG. 6) in the rail 124 of the base 14. The apertures 126 and 130 may receive a pin 134 (FIGS. 1 and 6) rotatably fixing the base 14 to the second mount 26.

In an example embodiment, the base 14 may be rotatably fixed to the second mount 26 to enable vertical alignment with a target downrange of the test fixture 10. The arrangement of the apertures 126 and 130 and the pin 134 allows the base 14 to pivot about a horizontal axis through the pin 134, moving the front face 50 along a vertical axis.

Referring now to FIGS. 1-8, as previously stated, the projection 78 may be a support receiving and supporting at least a portion of the barrel retention assembly 30. The barrel retention assembly 30 may act as an insert and retain and support a barrel 138 in the test fixture 10. In an example embodiment, the barrel retention assembly 30 may include the forward retainer 34 and the rearward insert 38 which physically hold the barrel 138.

In an example embodiment, the rearward insert 38, or sleeve, may be a tube-shaped insert 38 having a longitudinal aperture 142 that receives the barrel 138 therein. For example, the rearward insert 38 may be a cylindrical tube or sleeve. The longitudinal aperture 142 may include a diameter LAD that is slightly larger than an outer diameter BOD of the barrel 138. Therefore, the barrel 138 may be in press-fit engagement with the insert 38. Alternatively, the longitudinal aperture 142 in the insert 38 may include threads that engage threads on an outer surface of the barrel 138. Therefore, the barrel 138 may be threadably attached in the insert 38. In some examples, the threads may be coated with an adhesive (such as a threadlocker, epoxy, cold weld, etc.) or another fixing element to fix the engagement between the barrel 138 and the insert 38.

In an example embodiment, the barrel 138 outer diameter BOD may be approximately 1.095 inches (plus or minus 0.01 inches) and an outer diameter of threads (if applicable) may be approximately 1.155 inches (plus or minus 0.01 inches) with 16 threads per inch along the insert 38 length (or sleeve length). In an example embodiment, the insert 38 length (or sleeve length) may be approximately 4.880 inches (plus or minus 0.01 inches). In an example embodiment, the insert 38 outer diameter may be approximately 1.998 inches (plus or minus 0.01 inches, and more specifically plus 0.00 inches or minus 0.002 inches). While these dimensions are provided as examples, it is understood that they may vary based on different manufacturers of test barrels. It is understood that the fixture may be configured to accommodate any barrel length or diameter and, as such, the example dimensions provided herein may vary. In an example embodiment, the fixture 10 having the example dimensions herein may accommodate barrel 138 diameters in a range of 0.500 inches through 1.625 inches.

In an example embodiment, the rearward insert 38 may additionally include a stepped portion 146 on an end 150 opposite an end 154 that receives the barrel 138. The stepped portion 146 may engage a stepped portion 158 acting as a stop in the channel 54. The stepped portion 146 may include a decreased outer diameter from the outer diameter of the insert 38.

In an example embodiment, the forward retainer 34 may be a tube-shaped retainer 34 having a longitudinal aperture 162 that receives the barrel 138 therein. For example, the forward retainer 34 may be a cylindrical tube. The longitudinal aperture 162 may include a diameter FLAD that is larger than an outer diameter BOD of the barrel 138. For example, the longitudinal aperture 162 may include a diameter FLAD of approximately 1.630 inches (plus or minus 0.01 inches, and more specifically plus 0.005 inches or minus 0.00 inches), and the barrel 138 outer diameter BOD may be within a range of 0.500 inches to 1.625 inches. Therefore, the barrel 138 may be slideable within the retainer 34 without contacting a wall 166 of the longitudinal aperture 162 in the retainer 34. While these dimensions are provided as examples, it is understood that they may vary based on different manufacturers of test barrels. It is understood that the fixture 10 may be configured to accommodate any barrel length or diameter and, as such, the example dimensions provided herein may vary.

In an example embodiment, the forward retainer 34 may include an inserted section 170 and a protruding section 174. The inserted section 170 may be configured to be inserted within the channel 54. A ring 178 may project from an outer wall 182 of the inserted section 170, may extend around a circumference of the inserted section 170, and may be formed integral to the inserted section 170.

In an example embodiment, a diameter ROD of the ring 178 may be larger than an outer diameter FOD of the inserted section 170 of the forward retainer 34 such that a step 186 exists between the inserted section 170 and the ring 178. An exterior surface 190 of the ring 178 may engage a wall 194 of the channel 54. In an example embodiment, the diameter ROD of the ring 178 may be approximately 2.505 inches (plus or minus 0.01 inches, and more specifically plus or minus 0.005 inches), and the outer diameter FOD of the inserted section 170 may be approximately 2.00 inches (plus or minus 0.01 inches, and more specifically plus 0.00 inches or minus 0.015 inches). While these dimensions are provided as examples, it is understood that they may vary based on different manufacturers of test barrels. It is understood that the fixture 10 may be configured to accommodate any barrel length or diameter and, as such, the example dimensions provided herein may vary.

The wall 194 of the channel 54 may include a cutout 198 on the front face 50 end of the base 14 and in the projection 78. As illustrated in FIG. 6, the cutout 198 may widen the channel 54, creating a rear step 202 and a forward stop 206. For example, the forward stop may be a lip 206 separating the cutout 198 from an end of the projection 78 and may engage the step 186 created by the ring 178 on the inserted section 170. The forward stop 206 may therefore retain the forward retainer 34 in the channel 54.

In an example embodiment, the protruding section 174 may be configured to extend from the projection 78 on the base 14. In an example embodiment, a diameter POD of the protruding section 174 may be larger than the outer diameter FOD of the inserted section 170 and may be larger than the outer diameter ROD of the ring 178. A rear surface 210 of the protruding section 174 may engage a front surface 214 of the projection 78. In an example embodiment, the diameter POD of the protruding section 174 may be approximately 3.0 inches (plus or minus 0.01 inches, and more specifically plus 0.000 inches or minus 0.020 inches), the diameter ROD of the ring 178 may be approximately 2.505 inches (plus or minus 0.01 inches, and more specifically plus or minus 0.005 inches), and the outer diameter FOD of the inserted section 170 may be approximately 2.00 inches (plus or minus 0.01 inches, and more specifically plus 0.00 inches or minus 0.015 inches). While these dimensions are provided as examples, it is understood that they may vary based on different manufacturers of test barrels. It is understood that the fixture 10 may be configured to accommodate any barrel length or diameter and, as such, the example dimensions provided herein may vary.

In an example embodiment, the protruding section 174 may include one or more apertures 218 extending radially through the wall 166. The apertures 218 may be configured to receive fasteners for fixing the barrel 138 within the longitudinal aperture 162. For example, the apertures 218 may be threaded apertures which receive threaded fasteners. To fix the barrel 138 in the longitudinal aperture 162, the fasteners may be tightened in the threaded apertures until they contact the barrel 138. Pressure from the force of the fasteners on the barrel 138 at different angles may secure and fix the location of the barrel 138. Alternatively, the apertures 218 may receive fasteners in press-fit engagement. To fix the barrel 138 in the longitudinal aperture 162, the fasteners may be pressed in the apertures until they contact the barrel 138. Pressure from the force of the fasteners on the barrel 138 at different angles may secure and fix the location of the barrel 138. Alternatively, the apertures 218 may receive different fasteners to secure and fix the location of the barrel 138.

Now referring to FIGS. 6 and 7, a firing pin assembly 222 may be disposed in the partial circular portion 74 of the channel 54 and supported by the base 14. The firing pin assembly 222 may include a housing 226 having a longitudinal aperture 228. A rear support, or insert, 230, a front support, or insert, 234, and a firing pin 238 may be supported in the longitudinal aperture 228 of the housing 226. The rear support 230 and front support 234 may be positioned on opposing ends of the firing pin 238 and may cooperate to align and position the firing pin within the housing 226 and along the barrel 138.

In an example embodiment, the rear support 230 may be a cylindrical, or tubular, support having a large diameter portion 242 and a small diameter portion 246. The large diameter portion 242 may be countersunk on a free end 250 and includes a bore 254 having a first inner diameter portion 258. The first inner diameter portion 258 includes a diameter that may be slightly larger than a diameter of the firing pin 238, such that when the firing pin 238 is inserted in the bore 254, the firing pin 238 is slideable relative to the large diameter portion 258 and may move between a position protruding into the countersunk free end 250 and a position not protruding into the countersunk free end 250.

In an example embodiment, the small diameter portion 246 includes the bore 254 having a second inner diameter portion 262 and a third inner diameter portion 266. The second inner diameter portion 262 may be slightly smaller than the third inner diameter portion 266 such that when the firing pin 238 is inserted in the bore 254, a circumferential ridge 270 on the firing pin 238 is slideable within the third inner diameter portion 266 but too large to fit within the second inner diameter portion 262. Thus, the second inner diameter portion 262 may act as a stop for the firing pin 238, preventing further insertion into the bore 254.

In an example embodiment, the rear support 230 may be slideable within the longitudinal aperture 228. For example, the longitudinal aperture 228 may be countersunk on an end 274 receiving the rear support 230, with the countersink depth being equal to or slightly larger than a length of the large diameter portion 242. For example only, the countersink depth may be within a range of about 0.05-0.2 in. (plus or minus 0.010 in. tolerance) larger than a length of the large diameter portion 242. While these dimensions are provided as examples, it is understood that they may vary based on different firing pins.

In an example embodiment, the longitudinal aperture 228 may include a large diameter portion 278 on the countersunk end 274, a medium diameter portion 282, and a small diameter portion 286. A step 290 separating the countersunk end 274 and large diameter portion 278 from the medium diameter portion 282 of the longitudinal aperture 228 may provide a stop to prevent the rear support 230 from passing further into the longitudinal aperture 228.

In an example embodiment, the medium diameter portion 282 may include a diameter that is slightly larger than a diameter of the small diameter portion 246 of the rear support 230. The small diameter portion 286 may include a diameter that is slightly larger than a diameter of the firing pin 238.

In an example embodiment, the front support 234 may be a cylindrical support having a plurality of apertures 294, 298 through a thickness thereof. When assembled, a striking end 302 of the firing pin 238 may be inserted through one of the plurality of apertures 294, 298 (for example the center aperture 294) to align the firing pin 238 with a center of the barrel 138. The front support 234 may be disposed in an opposing end 306 of the longitudinal aperture 228 from the rear support 230. The opposing end 306 may be countersunk to receive the front support 234 therein.

Use of the front support 234 and rear support 230 provide interchangeability for firing pins. Thus, a variety of different firing pins may be used and tested in the test fixture 10 by simply swapping firing pins 238, front supports 234, and rear supports 230 (if necessary).

In an example embodiment, the firing pin assembly 222 may be vertically movable in the partial circular portion 74 of the channel 54. The firing pin assembly 222 may be fixed to a support 314 that is configured to pivot, either pulling the firing pin assembly 222 downward in the partial circular portion and exposing the barrel 138 or pushing the firing pin assembly 222 upward in the partial circular portion and into alignment with the barrel 138. In an example embodiment, the housing 226 of the firing pin assembly 222 may be fixed to the support 314 at an engagement between a slot 318 of the housing 226 and a finger 322 of the support 314. More specifically, the finger 322 of the support 314 may be disposed within the slot 318, and an aperture 326 in the finger 322 may align with an aperture 330 in the slot 318. The apertures 326, 330 may receive a pin or other fastener to fix the finger 322 in the slot 318.

In an example embodiment, the support 314 may be fixed to, and controlled by a lever 334. For example, the support 314 may be press-fit, or otherwise fixed on, a first end 338 of a rod 342, and the lever 334 may be press-fit, or otherwise fixed on, a second end 346 (opposite the first end 338) of the rod 342, such that when the lever 334 is raised or lowered, the finger 322 on the support 314 is raised or lowered as well.

In an example embodiment, a spacer 350 may also be fixed on the rod 342 between the first end 338 and the second end 346 and between the lever 334 and the support 314. For example, the spacer 350 may be a plate having an aperture that is press-fit, or otherwise fixed on, the rod 342, such that lever 334 is raised or lowered, the rod 342 turns to pivot the spacer 350 also. The spacer may pivot from a position abutting the rear face 46 of the base 14 to a position spaced from the rear face 46 of the base 14.

Referring now particularly to FIGS. 1, 6, and 7, in an example embodiment, a door, or access, 354 may be mounted to engage the rear face 46 of the base 14 and the spacer 350. For example, the door 354 may be pivotably mounted on a side face 358 of the base 14 that connects the rear face 46 with the front face 50 such that the door 354 may move from a closed position preventing access to the firing pin assembly 222 to an open position providing access to the firing pin assembly 222. In an example embodiment, the door 354 may pivot about a vertical axis and may move along a horizontal axis when moving from the closed position to the open position.

In an example embodiment, the door 354 may be mounted on the base 14 by a hinge 362 having a base 366 and an arm 370. The hinge base 366 may be fixed to the base 14 by at least one fastener 374 (for example, screws, adhesive, welding, etc.), and the arm 370 may be rotatably fixed to the hinge base 366 by a pin 378. In an example embodiment, the arm 370 may be fixed to the door 354 on an end opposite the pin 378.

In an example embodiment, the door 354 may be an L-shaped door with a horizontal portion 382 of the L-shape being on a top end of a vertical portion 386. A central aperture 390 may extend through a thickness of the door 354 and the arm 370 and align with a longitudinal axis through a center of the longitudinal aperture 228 and a center of the barrel 138. One or more additional apertures 394 (for example, two additional apertures) may extend through the thickness of the door 354 on opposing sides of the arm 370.

In an example embodiment, the door 354 may be fixed in the closed position by inserting a pin 388 (FIG. 2) into an aperture 392 (FIG. 5) in the horizontal portion 382 of the door 354 and into an aperture 396 (FIG. 5) in a protruding portion 400 of the base 14.

Now referring to FIGS. 1, 2, and 4-7, in an example embodiment, the actuation assembly 42 may be disposed on a rear face 398 of the vertical portion 386 of the door 354. The actuation assembly 42 may actuate the firing pin 238, firing a bullet or round through the barrel 138 (described in detail below). The actuation assembly 42 may provide a push button actuation feature that enables the test fixture to be fired from a safe distance. The operation of the actuation assembly 42 may be initiated by pushing a button only requiring a power source from any standard 110 volt AC outlet.

In an example embodiment, the actuation assembly 42 may include a magnet 402 (FIG. 7) having an end plate 406 and a coil 410. The end plate 406 may be attached to the coil 410 by biasing members 412. For example, biasing members 412 may be springs, such as helical or wave springs. In an example embodiment, biasing members 412 may be received within apertures 416 in end plate 406 and apertures 420 in coil 410. The biasing members 412 may each include a head 424 and a shaft 428. A diameter of the head 424 may be larger than the shaft 428 and the aperture 416 such that the shaft 428 extends through the aperture 416 but the head 424 does not. The head 424, instead retains the end plate 406 on the shaft 428. The shaft 428 of the biasing member 412 engages the aperture 420 in coil 410 on a free end 432. The biasing members 412 may bias the end plate 406 away from the coil 410. When the coil 410 is energized, the end plate 406 overcomes the biasing force, is pulled toward the coil 410, and contacts the coil 410.

In an example embodiment, the end plate 406 may include an outer ring 436 that receives the biasing members 412 and a central core 440 having an interior rod 444 projecting therefrom. The interior rod 444 may extend through a bore 448 and an aperture 452 in the coil 410. The interior rod 444 may further extend into and be slidable within the longitudinal aperture 390 in the door 354 and arm 370 and into the countersunk free end 250 to contact the firing pin 238.

In an example embodiment, the bore 448 may be a countersunk bore having a countersink depth $CD_B$ equal to a depth $CD_C$ of a protruding portion 454 of the central core 440. In another example embodiment, the countersink depth $CD_B$ of the bore 448 may be within a range of 0.5 to 1.5 in., and more specifically about 1.030 in. (plus or minus 0.010 in. tolerance) larger than the depth $CD_C$ of the protruding portion 454 of the central core 440.

In an example embodiment, a diameter DB of the bore 448 may be slightly larger than a diameter Dc of the protruding portion 454 of the core 440. More particularly, for example, the diameter DB of the bore 448 may be about 0.06 in. larger than the diameter Dc of the core 440. For example only, the diameter DB of the bore 448 may be about 1.360 in. (plus or minus 0.010 in. tolerance), and the diameter Dc of the core 440 may be about 1.300 in. (plus or minus 0.010 in. tolerance).

Now referring to FIGS. 1-7, in operation, the door 354 of the fixture 10 may be opened by removing the pin 388 from the apertures 392, 396 and rotating the lever 334 (tor example rotating the lever counter-clockwise). Rotation of the lever 334 causes rotation of the rod 342 which, in turn, rotates the spacer 350 and support 314. The spacer 350 pivots away from engagement with the rear face 46 of the base 14 and pivots the door 354 from the closed potion, engaging the rear face 46, to the open position, exposing the firing pin assembly 222. The door 354 may then be manually opened to a full open position, where the vertical portion 386 of the door 354 is orthogonal to, or at an angle greater than 90° with, a plane on the rear face 46 of the base 14.

Additionally, rotation of the rod 342 and support 314, rotates the finger 322, moving the firing pin assembly 222 and housing 226 vertically within the partial circular portion 74 of the base 14 from a first position with the firing pin 238 aligned along a longitudinal axis of the barrel 138 to a second position vertically lower than the first position and exposing the end 150 of the barrel 138.

In an example embodiment, with the end 150 of the barrel 138 exposed, ammunition or a projectile 500 may be loaded into the barrel 138. The projectile 500 may be inserted into a rearward end 504 of the barrel 138 such that a rear face 508 of the projectile 500 aligns with the rearward end 504 of the barrel 138.

In an example embodiment, the door 354 is returned to the closed position. The lever 334 is rotated back to its initial position, rotating the rod 342, the support 314, and the spacer 350. The support 314 moves the housing 226 and firing pin assembly 222 vertically back into alignment with the barrel 138 (i.e., the firing pin 238 is moved into alignment with a longitudinal axis through the barrel 138). The spacer 350 moves back into contact with the rear face 46 of the base 14. The user or a biasing member (for example, a helical spring) may return the door 354 to the closed position and into contact with the rear face 46. The pin 388 is then inserted into the aligned apertures 392 and 396 in the door 354 and protruding portion 400 of the base 14.

In the closed position, the striking end 302 of the firing pin 238 aligns with a primer 512 (or a center) on the rear face 508 of the projectile 500. Additionally, in the closed position, the rearward facing end of the firing pin 238 aligns with a center of the interior rod 444 in the end plate 406 of the actuation assembly 42.

Power may be supplied to the magnet 402 of the actuation assembly 42 by wiring 516. As previously mentioned, the wiring 516 may be connected to a power supply (for example, any standard 110 volt AC source, or any other power source). An opposing end of the wiring may be connected to the coil 410 of the magnet 402. Upon actuation, power may be supplied from the source to the coil 410 to create a magnetic field. In an example embodiment, the user may actuate the magnet by pushing a button 520 completing the circuit from the power supply to the coil 410. Accordingly, the actuation assembly 42 may provide the user with the ability to remotely actuate the actuation assembly 42.

When the coil 410 is energized, the coil 410 becomes a magnet, attracting the outer ring 436 of the end plate 406. The outer ring 436 of the end plate 406 moves toward the coil 410, overcomes biasing members 412, and is brought into contact with the coil 410. Central core 440 moves from an unactuated position away from the bore 448 into an actuated position within the bore 448. As central core 440 moves toward the front face 50, the interior rod 444 projecting from the core 440 moves toward the firing pin 238.

A front face 524 of the interior rod 444 contacts the rearward facing end of the firing pin 238. When the front face 524 of the interior rod 444 contacts the rearward facing end of the firing pin 238, the firing pin 238 is projected forward.

When the firing pin 238 is projected forward, the striking end 302 of the firing pin 238 slides through the aperture 294 in the front support 234 and into the barrel 138. When the striking end 302 of the firing pin 238 crosses into the barrel 138, the striking end 302 contacts the primer 512 of the projectile 500.

When the striking end 302 of the firing pin 238 contacts the primer 512 of the projectile 500, a small explosive charge in the primer 512 is ignited. The primer 512 ignites the propellant in the projectile 500, the main explosive that may occupy up to ⅔ of the cartridge in the projectile 500. When the propellant burns, a large amount of gas is generated very quickly. The sudden, high pressure of the gas splits a bullet from the end of the cartridge, forcing it down the barrel 138 at extremely high speed (for example, at about 300 m/s depending on the amount of propellant and type of projectile).

While a centerfire projectile 500 is illustrated and described, it is understood that the projectile may also be a rimfire projectile. In an example embodiment where the projectile 500 is a rimfire projectile, the firing pin 238 strikes and crushes a rim of the base of the projectile 500 to ignite the primer. Like the centerfire example, the primer ignites the propellant in the projectile 500. When the propellant burns, a large amount of gas is generated very quickly. The sudden, high pressure of the gas splits a bullet from the end of the cartridge, forcing it down the barrel 138 at high speed.

After the projectile 500 is fired, the circuit in the wiring 516 connecting the power source with the coil 410 is broken, interrupting the flow of current. The coil 410 no longer attracts the end plate 406. The force of the biasing members 412 overcome the force of the attraction between the coil 410 and the end plate 406, and the end plate 406, core 440, and interior rod 444 return to the original position separated from the coil 410.

In an example embodiment, a force from the explosion in the projectile 500 may return the firing pin 238 back to the original position.

In another example embodiment, a return spring (not pictured; for example, a 2 lb. spring) within the longitudinal aperture 228 may return the firing pin 238 back to the original position. The return spring may bias the firing pin 238 rearward, such that the circumferential ridge 270 of the firing pin 238 contacts the second inner diameter portion 262. When the coil 410 attracts the end plate 406, pushing the rod 444 into the firing pin 238, as earlier discussed, the force from the rod 444 overcomes the biasing force from the return spring and projects the firing pin 238 into the projectile 500. When the power source is disconnected from the coil 410 (i.e., without the magnetic force from the coil 410 attracting the end plate 406) there is no force to overcome the biasing force of the return spring, and the firing pin 238 is returned to its original position.

The pin 388 is removed from the apertures 392 and 396 unlocking the door 354. The door 354 may be opened from the first position to the second position, spaced from the rear face 46 of the base 14. The lever 334 is rotated to rotate the rod 342, support 314, and spacer 350 from the closed position to the open position. The spacer 350 pivots from the closed position abutting the rear face 46 of the base 14 to the open position spaced from the rear face 46. The support 314 is rotated to rotate the finger 322 and move the housing 226 and firing pin assembly 222 from the closed position with the firing pin 238 aligned with the barrel 138 to the open position exposing the end 150 of the barrel 138.

When the spacer 350 and housing 226 are in the open position, the user can access the barrel 138 at the rearward end 150 thereof. The remainder of the projectile 500 (for example, the cartridge) may be removed from the rearward end 150 of the barrel 138. The user may optionally reload the barrel 138 with a new projectile 500. In an example embodiment, the user may return the door 354, lever 334, rod 342, support 314, and spacer 350 to the closed position, as previously described.

In an example embodiment, the firing pin 238 may be changed by removing the firing pin assembly 222 and housing 226 from the partial circular portion 74 of the base 14. For example, a pin or other fastener may be removed from within the aperture 326 and aperture 330, allowing the finger 322 of the support 314 to be removed from the slot 318 in the housing 226. The lever 334 may then be rotated to rotate the finger 322 away from the slot 318 and the housing 226.

The housing 226 may then be removed from the partial circular portion 74 in the base 14, exposing the front support 234, rear support 230, and firing pin 238, which may be removed from the longitudinal aperture 228 in the housing 226.

In an example embodiment, assembly of the firing pin assembly 222 into the housing 226 may be performed while the housing 226 is removed from the base 14. The firing pin 238 is assembled into the rear support 230. A rearward-facing end of the firing pin 238 is inserted into the first inner diameter portion 258. The rearward-facing end of the firing pin 238 is inserted into the first inner diameter portion 258 until the circumferential ridge 270 of the firing pin 238 contacts the second inner diameter portion 262 which acts as a stop to properly place the firing pin 238 in the rear support 230.

In an example embodiment, the firing pin 238 and rear support 230 are placed in the longitudinal aperture 228 such that the rear support 230 aligns in the countersunk end 274 of the longitudinal aperture 228 matching the shape of the rear support 230. Once the firing pin 238 is inserted through the longitudinal aperture 228, one of the plurality of apertures 294, 298 (for example, the center aperture 294) of the front support 234 is aligned with the striking end 302 of the firing pin 238. The striking end 302 of the firing pin 238 is inserted through the aperture 294 in the front support 234, and the front support 234 is inserted into the countersunk portion on the opposing end 306 of the longitudinal aperture 228.

The housing 226 may then be inserted back into the partial circular portion 74 in the base. The finger 322 may be inserted in the slot 318 in the housing 226, and the aperture 326 in the finger 322 may be aligned with the aperture 330. The pin or other fastener may be inserted through the aperture 326 and aperture 330, securing the finger 322 in the slot 318. The lever 334 may then be rotated to rotate the finger 322 toward slot 318 and the housing 226, pushing the housing 226 vertically upwards within the partial circular portion 74, and the firing pin 238 into alignment with the longitudinal axis of the barrel 138.

Figure 8:
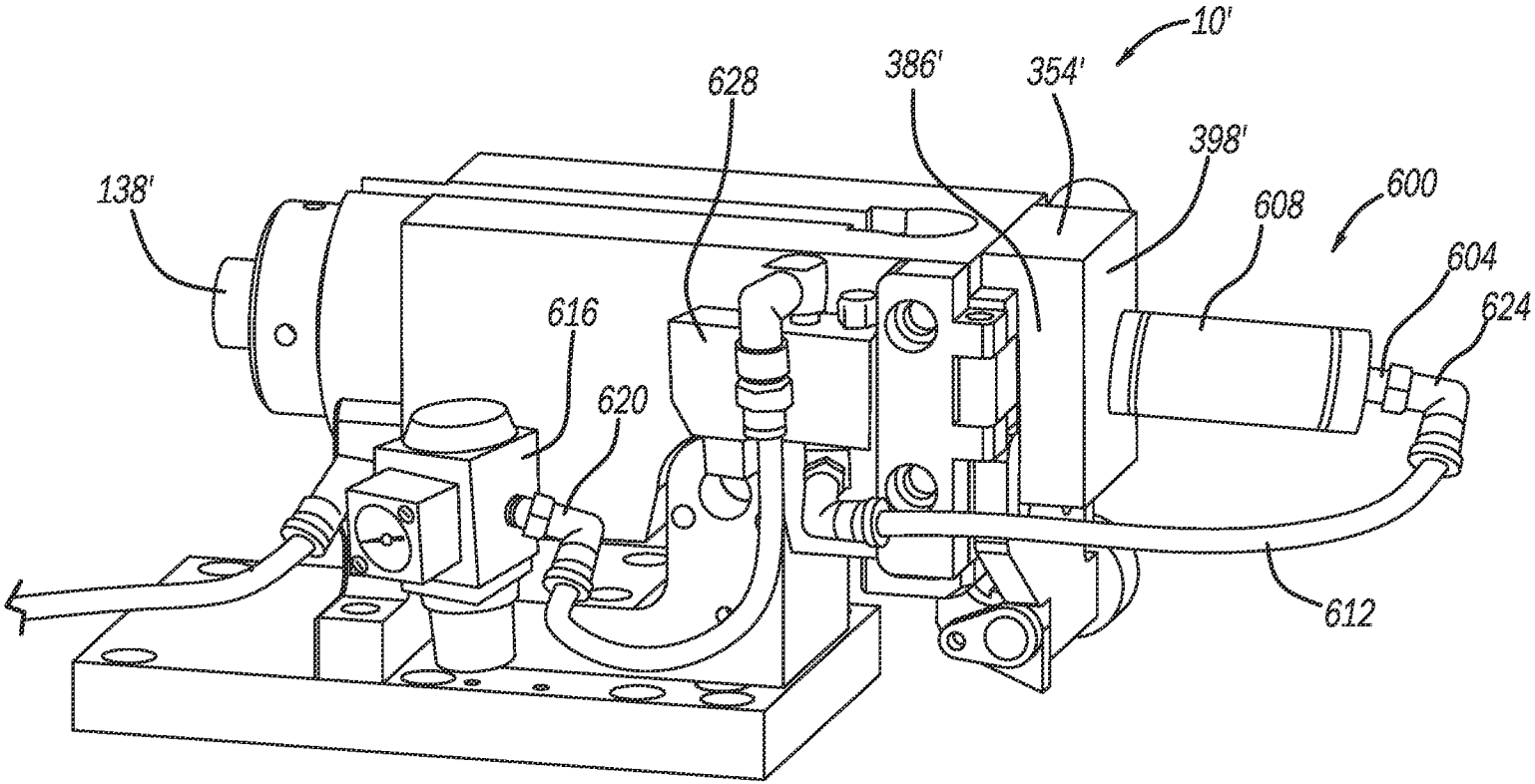
FIG. 8 is a side view of another example embodiment of a test fixture according to the present disclosure.

Now referring to FIG. 8, in an alternative example embodiment, a fixture 10' may include an actuation assembly 600 disposed on a rear face 398' of the vertical portion 386' of the door 354'. The actuation assembly 600 may actuate the firing pin 238', firing a bullet or round through the barrel 138'. The actuation assembly 600 may provide a push button actuation feature that enables the test fixture to be fired from a safe distance. The operation of the actuation assembly 600 may be initiated by remotely pushing a button.

In an example embodiment, fixture 10' may include all of the same elements as the fixture 10, previously described, except the actuation assembly 600 may replace the actuation assembly 42 in some elements. Thus, like numbers including a prime, for example 10 versus 10', may be used to indicate the same or similar elements that will not be re-described.

In an example embodiment, the actuation assembly 600 may provide compressed air to actuate an interior rod 444' into firing pin 238' (similar to the actuation process described with relation to fixture 10). The actuation assembly 600 may include a compressed air inlet 604, a compressed air tank 608, and the interior rod 444'.

A compressed air line 612 may provide compressed air to the compressed air tank 608. The compressed air line 612 may be connected to a valve 616 on a first end 620 and the air inlet 604 on a second end 624. In an example embodiment, the compressed air line 612 may include various devices 628 for monitoring or changing a pressure of the air in the compressed air line 612.

The compressed air line may be connected to a compressed air supply (for example, any standard compressor, or any other compressed air source). Upon actuation, compressed air may be supplied from the source to the tank 608 to force the interior rod 444' to move into contact with the firing pin 238'. In an example embodiment, the user may actuate the compressed air by pushing a button 520' opening the valve 616 from the air supply to the tank 608. Accordingly, the actuation assembly 600 may provide the user with the ability to remotely actuate the actuation assembly 600.

The remaining components and operation of the fixture 10' are the same as the fixture 10 as previously described.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A test fixture for testing firearms or ammunition, the test fixture comprising:

a base having a longitudinal channel;

a barrel retention assembly configured to support a firearm barrel in the longitudinal channel;

a door pivotably mounted to the base and configured to move from a closed position contacting a rear face of the base to an open position spaced from the rear face of the base; and a firing pin supported in a housing, the housing being slideably supported within the base and being configured to move between a first position and a second position, the first position aligning the firing pin and a longitudinal axis of the barrel retention assembly and the second position providing access to the barrel retention assembly.

2. The test fixture of claim 1, further comprising:

an actuation assembly configured to fire a projectile loaded in the firearm barrel.

3. The test fixture of claim 2, wherein the actuation assembly includes a magnet.

4. The test fixture of claim 3, wherein the magnet is activated by supplying power to the magnet, and the power is supplied to the magnet by pressing a remote button to complete a circuit between a power supply and the magnet.

5. The test fixture of claim 2, wherein the actuation assembly is fixed to the door.

6. The test fixture of claim 2, wherein the actuation assembly includes a coil, an end plate, and a rod projecting from the end plate into the door and the base.

7. The test fixture of claim 6, wherein when the actuation assembly fires the projectile, the rod moves within the base to contact the firing pin and press the firing pin into the projectile.

8. The test fixture of claim 1, wherein the firing pin is part of a firing pin assembly disposed in the housing, the firing pin assembly including a front support and a rear support positioning the firing pin within the housing.

9. The test fixture of claim 1, wherein the door moves along a horizontal axis when moving from the closed position to the open position.

10. A test fixture for testing firearms or ammunition, the test fixture comprising:

a base being configured to support a firearm barrel; and an actuation assembly configured to remotely fire a projectile loaded in the firearm barrel, the actuation assembly including a coil, an end plate, and a rod projecting from the end plate into the base, wherein when power is supplied to the coil, the coil becomes a magnet and the end plate moves from a position separated from the coil to a position contacting the coil.

11. The test fixture of claim 10, wherein the base includes a door pivotably attached on a side surface of the base, the door being configured to pivot from a closed position to an open position, and the actuation assembly is fixed to the door.

12. A method of testing firearms or ammunition, the method comprising:

opening a door pivotably attached to a base of a test fixture;

loading a projectile into a firearm barrel housed in the test fixture;

supplying power to an actuation assembly on the door of the test fixture to activate a magnet; and pushing a firing pin in the test fixture into the projectile.

13. The method of claim 12, wherein the supplying power to the actuation assembly includes remotely pressing a button to complete a circuit between a power supply and the actuation assembly.

14. The method of claim 12, wherein the pushing the firing pin into the projectile includes moving an end plate of the actuation assembly from a first position spaced from a coil to a second position contacting the coil when the magnet is activated, and moving a rod projecting from the end plate within a base of the test fixture to contact the firing pin and push the firing pin into the projectile.

15. The method of claim 12, wherein opening the door pivotably attached to the base of the test fixture includes pivoting the door of the test fixture from a closed position abutting the base to an open position spaced from the base, and loading the projectile into the firearm barrel housed in the test fixture includes:

rotating a lever which allows a housing supporting the firing pin to move from a first position to a second position, exposing a rear-facing end of the firearm barrel, loading a projectile into the rear-facing end of the firearm barrel, and rotating the lever to a closed position, moving the housing supporting the firing pin from the second position to the first position, aligning the firing pin with the projectile.

* * * * *